United States Patent [19]
Schulze et al.
[11] 4,317,656
[45] Mar. 2, 1982

[54] ARTICLE-DEFLECTING SWITCHING MEANS FOR A SYSTEM OF ARTICLE CONVEYORS

[75] Inventors: Ehrhart Schulze, Fellbach; Michael Berg, Remseck, both of Fed. Rep. of Germany

[73] Assignee: Karl Heinz Stiegler, Stuttgart, Fed. Rep. of Germany

[21] Appl. No.: 117,771

[22] Filed: Feb. 1, 1980

[30] Foreign Application Priority Data

Feb. 17, 1979 [DE] Fed. Rep. of Germany ..... 2906164
Oct. 9, 1979 [DE] Fed. Rep. of Germany ..... 2940924

[51] Int. Cl.[3] ..... B31B 1/94; B31B 23/02
[52] U.S. Cl. ..... 493/197; 198/438; 271/279; 493/204
[58] Field of Search ..... 493/193–197, 493/204, 203, 205, 208; 271/300, 302, 279, 284, 283, 183; 198/438

[56] References Cited

U.S. PATENT DOCUMENTS 2,211,046 8/1940 Barber ..... 271/300 X
3,162,436 12/1964 Halden ..... 271/284
3,162,437 12/1964 Poland et al. ..... 271/196 X
3,659,840 5/1972 Ruck ..... 271/279
3,861,669 1/1975 Kubo et al. ..... 271/94
3,941,374 3/1976 Vits ..... 271/183
3,947,020 3/1976 Kobayashi ..... 271/197 X
4,023,470 5/1977 Van der Meulen ..... 493/208 X
4,240,336 12/1980 Grevich et al. ..... 493/196

FOREIGN PATENT DOCUMENTS 2063875 6/1972 Fed. Rep. of Germany ..... 271/284
2725546 12/1978 Fed. Rep. of Germany .

*Primary Examiner*—James F. Coan
*Attorney, Agent, or Firm*—Hopgood, Calimafde, Kalil, Blaustein & Judlowe

[57] ABSTRACT

The invention contemplates an improved deflection-switch mechanism for a conveyor system which continuously handles a succession of articles, such as like sheets or sheet-like workpieces, on a first conveyor, and which sorts them in alternation to one and then to the other of two further conveyors, whereby in each of the further conveyors the sorted articles are more greatly separated and therefore can be subjected to more effective deceleration prior to their uniformly stacked accumulation. The deflection mechanism of the switch is vacuum-operative upon individual articles, relying upon their spatial distribution in the first conveyor as a basic determinant of whether a particular article is to be automatically deflected or switched, by effectively synchronous commutation, into one or into the other of the two further-conveyor paths. The switching deflection is accomplished continuously and without imposing any limitation upon the smooth high-speed transport of incoming articles to their finally stacked destination.

28 Claims, 6 Drawing Figures

ARTICLE-DEFLECTING SWITCHING MEANS FOR A SYSTEM OF ARTICLE CONVEYORS

BACKGROUND OF THE INVENTION

This invention relates to a conveyor for sheet-shaped workpieces which has a switch and feeds optionally two additional conveyors with workpieces fed to it from a first conveyor, in particular bags of thermoplastic material which are produced one after the other by a bag welding machine.

From German Pat. No. 2,229,286, German published application (Offenlegunschrift) No. 2,330,614 and German Patent (Auslegeschrift) No. 2,559,138, devices of this type are known in which the switch is developed as a tongue swingable about its one end, its free end being settable alternately to one or other of the inputs of two further conveyors, so that a workpiece which is fed to the end adjacent the swivel point of the tongue can be fed optionally to a selected one of the two further conveyors.

Devices of this type serve to divide a sequence of workpieces, particularly bags produced in rapid succession one after the other in a bag welding machine, into two series of workpieces by alternately conducting said workpieces to the two further conveyors, the distances between the successive workpieces in the two series of workpieces being then greater than the length of one workpiece, so that by reducing these distances the speed of conveyance of the workpieces can be substantially reduced. This is of importance in particular when the sheet-shaped workpieces are to be stacked to form flat piles.

Specifically, if a rapid sequence of sheet-shaped workpieces, for instance bags of thermoplastic material welded in a welding machine are stacked, the individual workpieces are thrown with relatively high speed against a stop upon their stacking and thereby suddenly decelerated. Due to the sudden deceleration, the rear parts of the workpiece push themselves over the front parts so that a dependable stacking is not possible with high speeds of delivery of the sheet-shaped workpieces.

The known switches provide some help in meeting the stacking problem, since the speed of conveyance of the sheet-shaped workpieces can be substantially reduced in the two further conveyors; thus, proper stacking is made possible even in case of rapid travel of the sheet-shaped workpieces in the first conveyor.

The known switches which operate with a tongue which can be swung in and out are, however, not suitable for the purpose of deflecting workpieces which are fed in very rapid sequence, since actuation of the switches causes increasing difficulties when the speed of succession of workpieces is increased.

BRIEF STATEMENT OF THE INVENTION

The object of the present invention is to create an apparatus of the aforementioned type in which the speed of succession of the workpieces can be increased practically as much as desired without increasing difficulties.

This object is achieved in accordance with the invention in such manner:

(a) that the switch has at least one deflection body which can be driven to rotate its peripheral surface and (b) is so arranged that advancing workpieces contact its peripheral surface at least by their leading edge, (c) that the deflection body has at least one suction aperture for drawing in said edge of the workpiece, (d) that the travel phase of the deflection body is so adapted to the conveyance phase of the first conveyor that at least the front edge of each selected workpiece contacts the peripheral surface of the deflection body in the region of the suction hole, and, (e) that, at least during the contact of the deflection body with a selected workpiece, the suction hole is connected with a space in which a vacuum is present so as to produce a suction flow in the suction hole.

The deflection body according to feature (a) can be driven at any desired speed. Due to the fact that, in accordance with feature (b), it is so arranged that advancing workpieces contact its peripheral surface at least by their leading edge, the result is obtained that this front edge of the workpiece which contacts the peripheral surface is drawn to the deflection body by the suction aperture of feature (c), and in this way the sheet-shaped workpiece which is thus drawn-in is fed into a new conveyance path to a further conveyor. Feature (d) assures that the front edge of at least of each selected workpiece, for instance the front edge of every second workpiece, contacts the peripheral surface of the deflection body in the region of the suction aperture so that, as a result of feature (e), at all times only the selected workpiece, for instance every second workpiece, is deflected. The first conveyor thus conducts the workpieces conveyed by it to one of the further conveyors, and the deflection body deflects the selected workpieces, for instance every second workpiece fed by the first conveyor, and brings it to the second further conveyor. The only part which is subjected to accelerated motion in this connection is the front edge of the workpiece which is drawn in by the suction aperture. However, since the weight of the sheet-shaped workpiece is small and the suction force is relatively large, the inertial reaction to acceleration force is so slight as compared with the suction force that one can operate here practically with all industrially possible speeds and time sequences of workpieces.

In order to permit better spatial separation of the further conveyors from each other, one advantageous embodiment of the invention is so developed that the switch has at least two deflection bodies which form a pair, and the peripheral surfaces of these bodies are driven in opposite directions and define a conveyance slot into which the first conveyor path discharges and that the two deflection bodies deflect the workpieces entering into the conveyor gap in accordance with the selection, preferably alternately, into the correct one of the two further conveyors.

In the indicated embodiment, the switch has at least two deflection bodies which form a pair and the peripheral surfaces of these bodies are driven in opposite directions, thereby obtaining the result that the sheet-shaped workpieces fed by the first conveyor are deflected as desired, preferably alternately, in opposite directions by the one or the other deflection body and are thereby fed to different further conveyors.

In another advantageous embodiment, the switch is arranged behind a welding machine having a continuously rotating welding strip for the manufacture of bags of thermoplastic resin. In such case, the frequency of revolution of the revolving deflection body is synchronized with the frequency of revolution of the welding strip. As a result, for instance, in the above-indicated embodiment having at least two deflection bodies, the front edge of each workpiece alternately contacts the peripheral surface of one or the other deflection body in the region of an operative suction aperture and is thereby correspondingly deflected.

The deflection bodies may advantageously be bodies of revolution, for instance rollers or disks or endless moving toothed bodies such as toothed belts or the like, in which, by reason of tooth-engagement, a deflection body in the form of such a belt always assumes a precisely defined position with respect to the associated disk; thus, such a belt-shaped deflection body can be provided with suction apertures which coincide with a suction aperture in the deflection disk only when a sheet-shaped workpiece just contacts the deflection body in the region of its suction aperture.

Should the deflection bodies be in the form of bodies of revolution, a relatively large structural expense is required, since such deflection bodies exert essentially merely a deflecting action to deflect workpieces out of their path of conveyance, with little or no transport effect; as a consequence, the first conveyor (which feeds the workpieces to the switch) and the conveyor which transports workpieces that have been deflected by the switch must be so arranged that the end of the first-conveyance path and the start of the transport-conveyance path effectively extend into the operative region of the deflection switch. On the other hand, if toothed belts are used as the deflection bodies, more favorable conditions result, since in the belt embodiment the deflection body provides a transport function in addition to a deflection function; the workpieces are therefore already under control of the deflection body for further transport on the last part of their transport path before reaching the deflection point of the switch, and they can be conveyed away from the switch by the deflection body after the deflection function has been performed. It is observed that the toothed-belt advantage of the combined conveyance and deflection action is disadvantageously obtained, in view of the fact that toothed belts are very expensive structural parts and can furthermore be obtained on the market only in specific stipulated lengths, with too short a maximum length. Therefore, in addition to increased manufacturing and operating expenses, toothed belts involve disadvantageous restrictions in design possibilities, in that existing available lengths and the insufficient maximum length of such belts must be tolerated.

With one particularly preferred embodiment, it is therefore contemplated that the use of a deflection body with combined conveying and deflecting action be made possible without having to tolerate the above-indicated disadvantage of the increase in expense and/or limitation of the design possibilities.

This particularly preferred embodiment contemplates that the deflection body be provided in the form of at least one endless conveyor belt which is characterized over its entire length with an air-pervious region; at the deflection point of the switch, said air-pervious region so wraps around a limited operative circumferential region of a deflection roller as to enable the belt to transfer suction control from the deflection roller to the workpiece. More specifically, the circumferential surface of the deflection roller has at least one suction opening which communicates with the space having the vacuum and which cooperates with the air-pervious region of the conveyor belt; and the limited circumferential extent of the deflection roller and the longitudinal distance between the leading edges of two workpieces fed in succession to the switch are in such relation to each other that one variable is an integer multiple of the other.

Due to the fact that the size of the limited operative circumferential region of the deflection roller (over which the air-pervious conveyor belt serving as deflection body is guided) is in the said integral relationship to the longitudinal distance between the leading edges of the successive workpieces which are fed to the switch, the result is obtained that the suction aperture of the deflection roller is always directed at the deflection point of the switch, namely, toward the front edge of a workpiece, so that by means of the suction opening and the air-pervious region of the conveyor belt resting against it, the suction stream is operative in the region of the front edge of the workpiece which is to be deflected. If the longitudinal distance between the leading edges of the successive workpieces is the same as, or a multiple of, the size of the circumference of the deflection roller, then either each workpiece will be deflected or any desired selected workpiece can be deflected by controlling the vacuum within the deflection roller. On the other hand, if the operative circumferential extent of the deflection roller is made twice as large as the longitudinal distance between leading edges of two adjacent workpieces fed to the switch, then each second workpiece is deflected in advantageous manner. The use of an air-pervious conveyor belt as deflection body instead of toothed belts assures, on the one hand, the desired advantage of decrease in cost since air-pervious conveyor belts are substantially cheaper than toothed belts and, on the other hand, provides flexibility to design possibilities, since air-pervious belts are available in any desired length and in the most varied embodiments, for instance in the form of fabric belts or strap-like structures provided with perforation holes.

The fact that air-pervious conveyor belts are available in any desired and practically unlimited lengths affords the additional advantage that the air-pervious conveyor belt can also provide the conveyor surface of the first conveyor, which leads the workpieces from the welding machine to the switch; the same air-pervious conveyor belt may also provide the conveyor surface of one of the second conveyors which transports the workpieces away from the deflection point of the switch.

DETAILED DESCRIPTION OF PREFERRED EMBODIMENTS

The invention is explained in detail in the following description of illustrative embodiments, taken in conjunction with the accompanying drawings in which.

Figure 1:
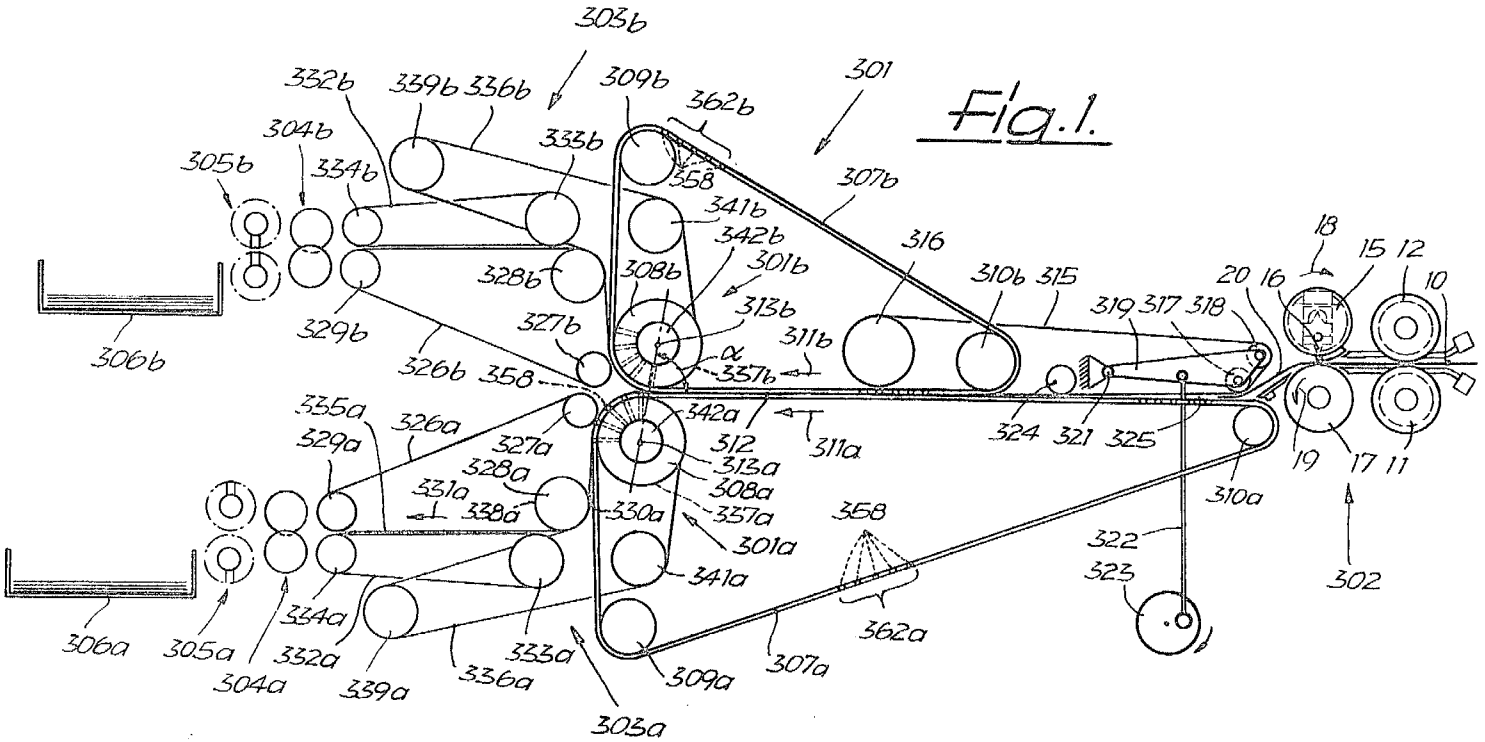
FIG. 1 is a side view in diagrammatic and greatly simplified form, showing a first embodiment, involving switch structure wherein two deflection devices act in opposite directions.

Referring initially to the embodiment of FIG. 1, a conveyor device for sheet-shaped workpieces is shown to include a switch 301 which consists of a lower deflection device 301*a* and an upper deflection device 301*b*. Switch 301 is supplied in rapid sequence with bags 20 of thermoplastic resin produced in a bag-welding machine which is designated generally as 302 and which has been merely diagrammatically indicated in FIG. 1. The two deflection devices 301*a* and 301*b* cause these bags 20 to be alternately fed to two further conveyors 303*a* and 303*b*, which feed the bags 20 via grooved-disk systems 304*a* and 304*b*, respectively, and via pairs of brake shafts 305*a* and 305*b*, respectively, to separate stacking places 306*a* and 306*b*, respectively, where the bags 20 are stacked in the form of flat piles; such grooved disk systems and brake-shaft systems are known for the indicated purpose and therefore need not be further described.

The bag-welding machine 302 can be developed in any known manner. The embodiment of a conveyor device for plastic bags which is described here is, however, particularly suitable for welding machines which produce bags at a very high rate. Bag-welding machines of this type operate with a welding tool which rotates continuously but preferably with non-uniform, ajustable circumferential speed. Such high-output bag-welding machines are known, for instance, from German Pat. No. 1,479,807 and are described in German application Nos. 2,810,204, 2,810,127 and 2,846,220. The conveyor device described here can, however, also be used with the bag-manufacturing machines of smaller capacity which operate with a welding strip which moves up and down and with an intermittently fed web of sheeting.

The welding machine 302 shown in FIG. 1 has two feed rollers 11 and 12 and a welding roller 15 which rotates continuously but with non-uniform speed; welding roller 15 cooperates with a counter roller 17. The feed rollers 11 and 12 form a conveyor slot for feeding a longitudinally slit tubular thermoplastic web of sheeting 10 to a welding slot between the welding roller 15 and the counter roller 17. The welding roller 15 has a welding tool 16 which, upon rotation of the welding roller 15 in the direction of an arrow 18, together with the counter roller 17 which rotates in opposite direction as indicated by an arrow 19, effects a separation welding; a bag 20 is thereby separated from the sheeting 10 and at the same time a first side seam, lagging in the direction of conveyance, is formed on the bag 20 while a second seam is formed on the front edge of the tubular sheeting web 10, thus defining a leading side seam for the next bag.

Each of the two different devices 301*a* and 301*b* has a plurality of lower and upper toothed belts 307*a* and 307*b* respectively traveling alongside of each other in parallel vertical planes (FIGS. 1, 2, and 3), and each of the toothed belts 307*a* and 307*b* is so supported for travel in the direction indicated by the arrows 311*a* and 311*b*, respectively, on three toothed-belt disks 308*a*-309*a*-310*a* and 308*b*-309*b*-310*b*, respectively, that each of the lower toothed belts 307*a* revolves in the same vertical plane as a corresponding upper toothed belt 307*b*.

The toothed-belt disks which bear the same reference numbers (308*a*-308*b*) are arranged coaxially, in axially spaced array. Thus, in any viewing aspect which is perpendicular to their plane of travel, the toothed belts 307*a* on the one hand and 307*b* on the other hand coincide with one another. The upper course of each lower toothed belt 307*a* contacts the lower course of each upper toothed belt 307*b* in a horizontal plane so that the upper courses of the toothed belts 307*a* form with the lower courses of the toothed belts 307*b* a horizontal conveyance slot 312 for the bags 20 (FIG. 1).

The axes 313*a* and 313*b* of the toothed-belt disks 308*a* and 308*b*, respectively (which are located adjacent to each other at the operative outlet of the switch 301) are arranged parallel to each other in a plane which forms an angle $\alpha$ of less than 90° with the horizontal plane of the conveyor slot 312 of the switch. In this way, the clearance between the toothed-belt disks 308*a* and 308*b* (which clearance is necessary for contact between the toothed belt courses in the conveyor slot 312 when the disks are arranged vertically above each other) can be enlarged by a factor of $1/\sin\alpha$ in order to compensate for variations in thickness of the toothed belts without losing the contact of the toothed-belt courses.

Figure 3:
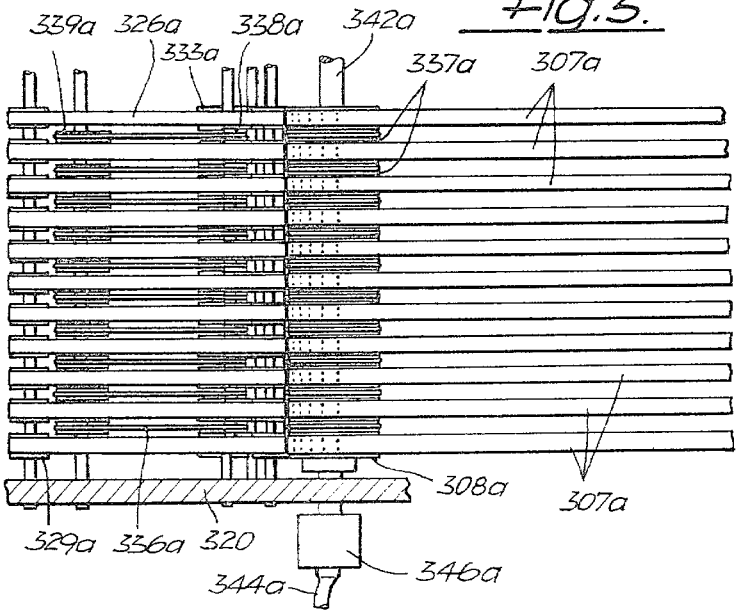
FIG. 3 is a plan view of the lower deflection device of FIG. 1 and of an additional conveyor arranged beneath it.
Figure 5:
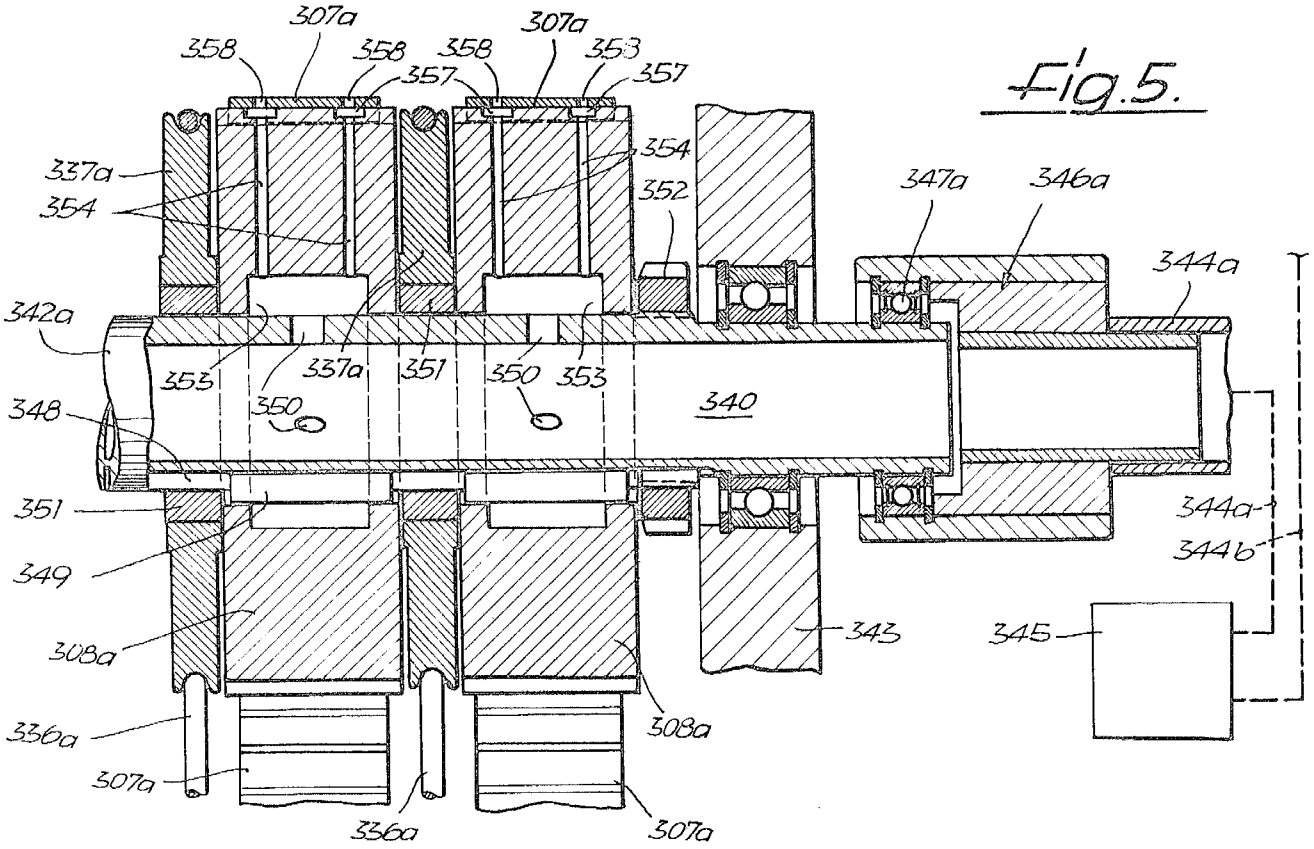
FIG. 5 is a sectional view, taken on the alignment V—V of FIG. 4, to show a plurality of coaxially arranged toothed-belt disks, and the communication of a suction channel with suction apertures in the toothed belt.

The distance of the toothed belt disks 310*b* from the toothed belt disks 308*b* is less than the distance of the toothed belt disks 310*a* from the toothed belt disks 308*a* so that the conveyor slot 312 commences only at a predetermined distance from the outlet of the welding machine 302. In order to bridge over this distance belts 315 of round section are provided in the spaces between the toothed belts 307*b*; these round belts 315 travel around round-belt disks 316 located leftward of disks 310*b* (in the sense of FIg. 1) and around rollers 317 and 318 (located to the right of disks 310*b*) having grooves for the round belts 315. These rollers 317 and 318 extend over the entire width of the switch 301 and are rotatably supported at their ends by suspension arms 319; arms 319 extend longitudinally away from the rollers 317 and 318 and are supported for swinging around a common axis 321 in the machine frame, only the walls 320 and 343 of which are shown in FIGS. 3 and 5, respectively. The suspension arms are actuated in vertical oscillation, by reason of actuating rods 322 which link arms 319 to crank disks 323. Between the round-belt disks 316 at one end and the round-belt rollers 317 and 318 at the other end, there is provided a roller 324 which extends over the entire width of the switch 301; the lower side of roller 324 rests against the lower courses of the round belts 315 and is adjustably and rotatably supported at its two ends of an axis parallel to the conveyor slot 312 in the machine frame. The round belts 315 and the toothed belts 307*a* define an inlet slot 325 ahead of the conveyor slot 312; this inlet slot is continuously operated to open and close, responsive to rotation of the crank disks 323. The crank disks 323 are so connected with the drive of the welding roller 15 that each time that a welding is concluded by the welding tool 16, the inlet slot closes, and the separated bag 20 whose leading edge has entered into the opened inlet slot 325 is clamped fast in the inlet slot 325 and is conveyed into the conveyor slot 312 by the toothed belts 307*a* and round belts 315, all of which run with the same peripheral speed.

The two further conveyors 303*a* and 303*b* are developed symmetrically with respect to the plane of the conveyor slot 312 so that the description of one conveyor 303*a* serves also to explain the construction of the second conveyor 303*b*.

The conveyor 303*a* comprises a number of spaced conveyor belts 326*a*, corresponding to the number of toothed belts 307*a*, each conveyor belt 326*a* being so supported on conveyor-belt disks 327*a*, 328*a* and 329*a* that the conveyor-belt course extending between the conveyor belt disks 327*a* and 328*a* rests against the adjacent toothed belt 307*a* and defines with the latter a conveyor slot 330*a*. One row of the coaxial conveyor-belt disks, for instance, the conveyor belt disks 328*a*, is driven in such a manner that the conveyor belts 326*a* revolve in the direction indicated by an arrow 331*a* and with the same peripheral speed as the toothed belts 307*a*.

Each conveyor belt 326*a* is associated with a conveyor belt 332*a* which travels around two conveyor-belt disks 333*a* and 334*a*. The conveyor-belt disks 333*a* on the one hand and the conveyor-belt disks 334*a* on the other hand are supported on common shafts which are so arranged that the upper courses of the conveyor belts 332*a* rest against the lower courses of the conveyor belts 326*a*, i.e., the courses which extend between the conveyor-belt disks 328*a*, and 329*a*, and thereby define a conveyor slot 335*a*.

In order now to deflect a bag coming from the conveyor slot 330*a* into the conveyor slot 335*a*, round belts 336*a* are provided in the continuous spaces between the toothed belts 307*a* and the conveyor belts 326*a* and 332*a*, which round belts are so guided on round belt disks 337*a* (FIGS. 3 and 5), 338*a*, 339*a*, and 341*a* that, together with the conveyor belts 326*a*, they effect a deflection of bags (workpieces) from the conveyor slot 330*a* into the conveyor slot 335*a*, as can be noted in particular from FIG. 1.

The corresponding parts of the further conveyor 303*b* are designated with the same reference numbers in the drawing, except that the letter a has been replaced by the letter b.

The toothed-belt disks 308*a* (308*b*) are secured, together with the round-belt disks 337*a* (337*b*) on hollow shafts 324*a* (342*b*) which are rotatably supported in the side walls 320 and 343 of the machine frame, the shaft 342*a* being shown as typical, in FIG. 5. The hollow interior 340 of hollow shaft 342*a* communicates via a hose 344*a* with a suction blower 345. For this purpose, the hose 344*a* is connected with a suction-air connection 346*a* which is rotatably supported on the open end of the hollow shaft 342*a* by means of a deep-groove ball bearing 347*a* which is sealed on both sides, thus providing a sealed rotary connection of hose 344*a* to the rotatable shaft 342*a*. In corresponding manner, the hollow inside of the hollow shaft 342*b* (FIG. 2) which carries toothed-belt disks 308*b* and round-belt disks 337*b* will be understood to have sealed rotary connection to the suction blower 345, via hose 344*b*.

The outer surface of hollow shaft 342*a* is characterized by an axial groove 348 for keys 349, whereby the associated toothed-belt disks 308*a* are securely keyed for rotation with the hollow shaft. Between the toothed-belt disks 308*a*, spacer rings 351 mount the round-belt disks 337*a* to shaft 342*a*, said disks being clamped fast between the toothed-belt disks 308*a* by threaded-nut means 352.

Figure 4:
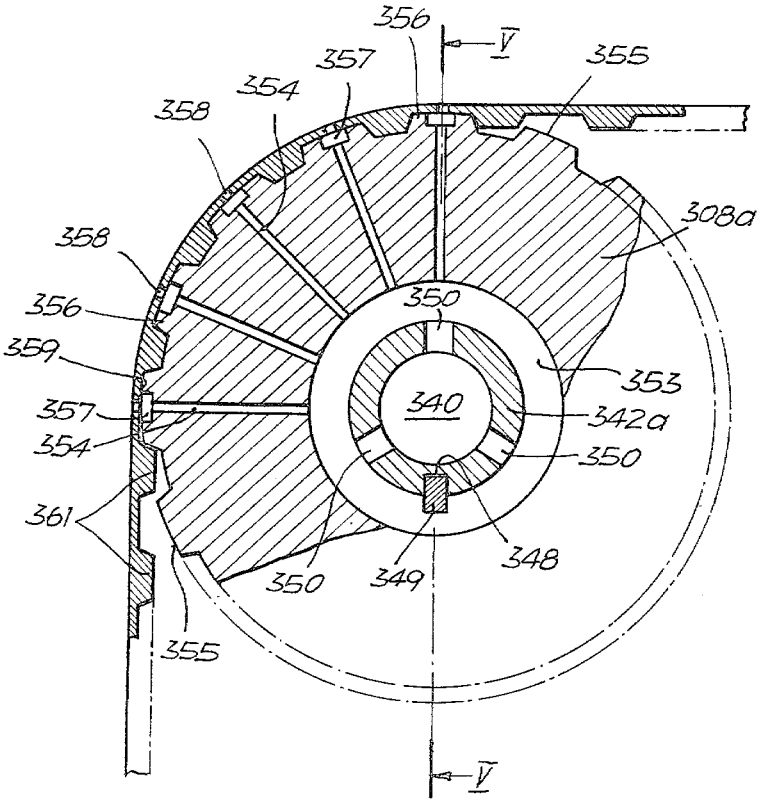
FIG. 4 is an enlarged fragmentary side view, shown partially broken away and in vertical section, of a toothed belt and disk of the lower deflection device of FIG. 1.

Each toothed-belt disk 308*a* is provided in the wall of its central bore with an annular groove or manifold 353. Furthermore, each toothed-belt disk 307*a* has ten radial boreholes 354 which are so arranged in five angularly spaced pairs of radially extending planes that their outer ends are open at the top land 355 of five adjacent teeth 356, while their inner ends communicate with the annular groove 353. The borehole ends 357 at the top-land surface of the teeth 356 are widened beyond the cross-sectional limit of the radial boreholes 354, at least in the width-wise direction of the associated tooth, and in all directions in the case of the embodiment shown in the drawing. The number of pairs of radial bores 354 is so selected that the rows of borehole openings extending in the circumferential direction of the toothed-belt disk extend over a section of the toothed-belt disk circumference which is approximately as long as the length of the section of the toothed belt disk circumference wrapped by the corresponding toothed belt 307*a*, as can be noted for the instant of time of the situation depicted in FIG. 4. Communication of the annular grooves 353 with the hollow insides 340 is via boreholes 350 in both hollow shafts 342*a* and 342*b*.

In each toothed belt 307*a* there are arranged a plurality of groups 362*a*—three in the embodiment shown—of suction holes 358, arranged in neighboring bottom lands 359 between two teeth 361, in such a manner that, with a corresponding arrangement of the toothed belt 307*a* on the toothed-belt disk 308*a*, the suction holes 358 coincide with the mouths 357 of the radial boreholes 354. The adjacent groups 362*a* of suction holes 358 are in this connection so arranged that twice as many teeth 361 are present between the suction holes which coincide with the same pairs of borehole mouths 357 upon rotation of the toothed belts 307*a* as are present on the toothed-belt disk 308*a*.

In exactly the same manner, the toothed-belt disks 308*b* also communicate with their hollow shaft and also have radial boreholes 354, the mouths of which coincide with suction boreholes 358, in the course of continuous movement of the toothed belts 307*b*. However, since the toothed belts 307*b* are shorter than the toothed belts 307*a*, only two groups 362*b* of suction boreholes 358 are provided in the toothed belts 307*b*, for the embodiment shown.

The toothed-belt disks 308*a* and 308*b* have a circumferential extent such that, for each revolution of the toothed-belt disks, the toothed belts 307*a* and 307*b* are moved a distance which is as long as the width of the widest bag measured in the conveyor direction 311*a*–311*b*. As a result, the front edge of each bag fed through the conveyor slot 312 to the outlet of the switch 301 always lies opposite the same segment of the toothed-belt disks 308*a* and 308*b*.

The toothed-belt disks 308*a* and 308*b* are secured in such phase relation with respect to each other on their hollow shafts that the outer ends of the radial boreholes 354 are always symmetrical to the plane of the conveyor slot 312 and thus are always present at the same time and in the same association at the switch outlet, as is shown in FIG. 1.

The hollow shaft 342*a*, in the same way as the hollow shaft 342*b* which bears the toothed-belt disks 308*b*, is driven with the same number of revolutions per unit time as the welding roller 15. In this connection, the toothed-belt disks 308*a* and 308*b* have the same diameter, which diameter, however, is sufficiently large that the advance of a bag caused upon one revolution of the toothed-belt disks 308*a* and 308*b* is somewhat greater than the advance of the web of material 10 effected during one revolution of the welding roller 15. In order to produce the same speed of advance for the round belts 315, the round-belt disk 316 is also correspondingly driven. The result is thus obtained that the bags 20 ejected by the welding machine 302 are moved with a somewhat higher speed of advance than the web of material 10, thereby assuring a predetermined separation of each new bag from the web of material 10.

Figure 2:
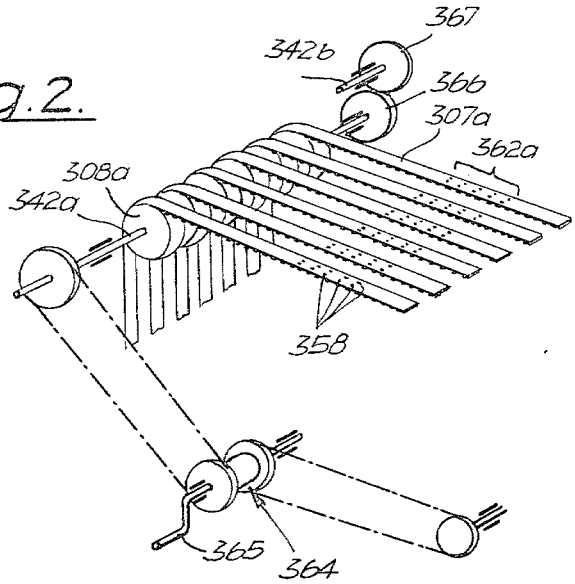
FIG. 2 is a fragmentary perspective view of the lower deflection device of the switch of FIG. 1.

The hollow shaft 342*a* is driven via a phase-adjustment mechanism 364 (FIG. 2). Differential gearing may be used for this purpose or, preferably, a mechanism manufactured by the Harmonic Drive System GmbH and known on the market as a "Harmonic Drive Differential". The phasing mechanism 364 is provided with a handle 365 by means of which the phase relationship of the toothed-belt disks 308 can be adjusted without changing the speed of rotation. The hollow shaft 342*a* is connected via two gears 366 and 367 with the hollow shaft 342*b* so that the latter is driven with the same speed of rotation but in the direction opposite to that of the hollow shafts 342*a*. In turn, the toothed belts 307*a* and 307*b* are so arranged on their toothed-belt disks 308*a* and 308*b* that whenever the borehole openings 357 of the toothed-belt disks 308*a* coincide with the suction holes 358 of the toothed belts 307*a*, the borehole openings 357 of the toothed belt disks 308*b* are covered by those segments of the toothed belts 307*b* which are not provided with suction holes. This is possible due to the fact that between the corresponding borehole openings 357 both of the toothed belts 307*a* and of the toothed belts 307*b*, there are twice as many teeth 361 as the toothed-belt disks have, so that the borehole openings 357 of each toothed belt disk 308*a* and 308*b* coincide with the suction holes 358 of adjacent groups 362*a* and 362*b* in all cases only after every second revolution of each toothed belt disk 308*a* and 308*b*.

The manner of operation of the embodiment will be explained below with reference to FIG. 1.

By means of the feed rollers 11 and 12, the web of material 10 is introduced into the slot between the welding roller 15 and the counter roller 17. As long as the welding tool 16 is still not in the welding position, the inlet slot 325 is open. At the instant when the welding tool 16 separates a bag 20 from the continuously fed web of material 10, the inlet slot 325 closes, so that the bag is clamped fast between the toothed belts 307*a* and the round belts 315 and is introduced into the conveyor slot 312 with a somewhat higher speed than the speed of the web of material 10. During operation of the machine, the suction blower 345 is continuously in operation so that the radial boreholes 354 of all toothed-belt disks 308*a* and 308*b* are always connected with the hollow space 340 of the hollow shafts 342*a* and 342*b*, which hollow space is under a vacuum. By means of the phasing mechanism 364 (FIG. 2), the phase relationship of the toothed-belt disks 308*a* (and thus automatically of the toothed belt disks 308*b*) is so adjusted that whenever the front edge of a bag 20 comes into the space between the toothed-belt disks 308*a* on the one hand and 308*b* on the other hand, either the suction holes 358 of the toothed belts 307*a* or the suction holes 358 of the toothed belts 307*b* are in the region of the front edge of the bag. Since then the suction holes 358 of each toothed belt 307*a* (or 307*b*) coincide with the radial boreholes 354 (at the associated openings 357) upon contact with the circumference of the corresponding toothed-belt disk 308*a* (or 308*b*), the front edge of the bag is drawn against the corresponding toothed belt 307*a* (or 307*b*) and is thereby held against the toothed belt until the front edge of the bag passes into the conveyor slot 330*a* (or 330*b*), whence it is then introduced by means of the round belts 336*a* and 336*b* respectively into the conveyor slot 335*a*, and is thence fed via the grooved-disk system 304*a* to the pair of brake shafts 305*a* and 305*b*, respectively. Due to the arrangement of the groups 362*a* and 362*b* of the suction holes 358 in the toothed belts 307*a* and 307*b* of the two different deflection devices 301*a* and 301*b* respectively, successive bags are always individually and alternately fed to the further conveyors 303*a* and 303*b*, and there is always present between the successive bags in the further conveyors 303*a* and 303*b* a distance corresponding at least to the length of one bag, so that the bags can now be strongly decelerated by the pair of brake shafts 305*a* and 305*b*, respectively, before ejection to the stacking places 306*a* and 306*b*, respectively.

The embodiment which has been described above and shown in the drawing represents a preferred embodiment. However, the invention can also be developed in many modifications. Thus it is sufficient, for instance, in order to achieve the same purpose, merely to provide the deflection device 301*b*, which then deflects every second bag out of the straight path of the conveyor slot 312. The conveyor slot could in this connection be formed in the manner that, instead of the toothed belts 307*a*, ordinary conveyor belts are provided which extend in the plane of the conveyor slot 312 beyond the deflection device 301*b* and which there define a further conveyor slot with the lower courses of conveyor belts arranged above same, in the same manner as the conveyor slot 335*a*.

Another possible modification consists in providing deflection rollers as deflection bodies rather than the toothed belts 307*a* and 307*b*. These deflection rollers would then, to be sure, have to have a diameter which is at least twice as great as the toothed-belt disks 308*a* and 308*b*.

Ten suction holes are provided in the preferred embodiment. Depending on the size of the bag, a larger or smaller number of suction holes can be provided; for instance, in certain cases, it may be sufficient if only a single suction hole is present for drawing-in the front edge of the bag.

Figure 6:
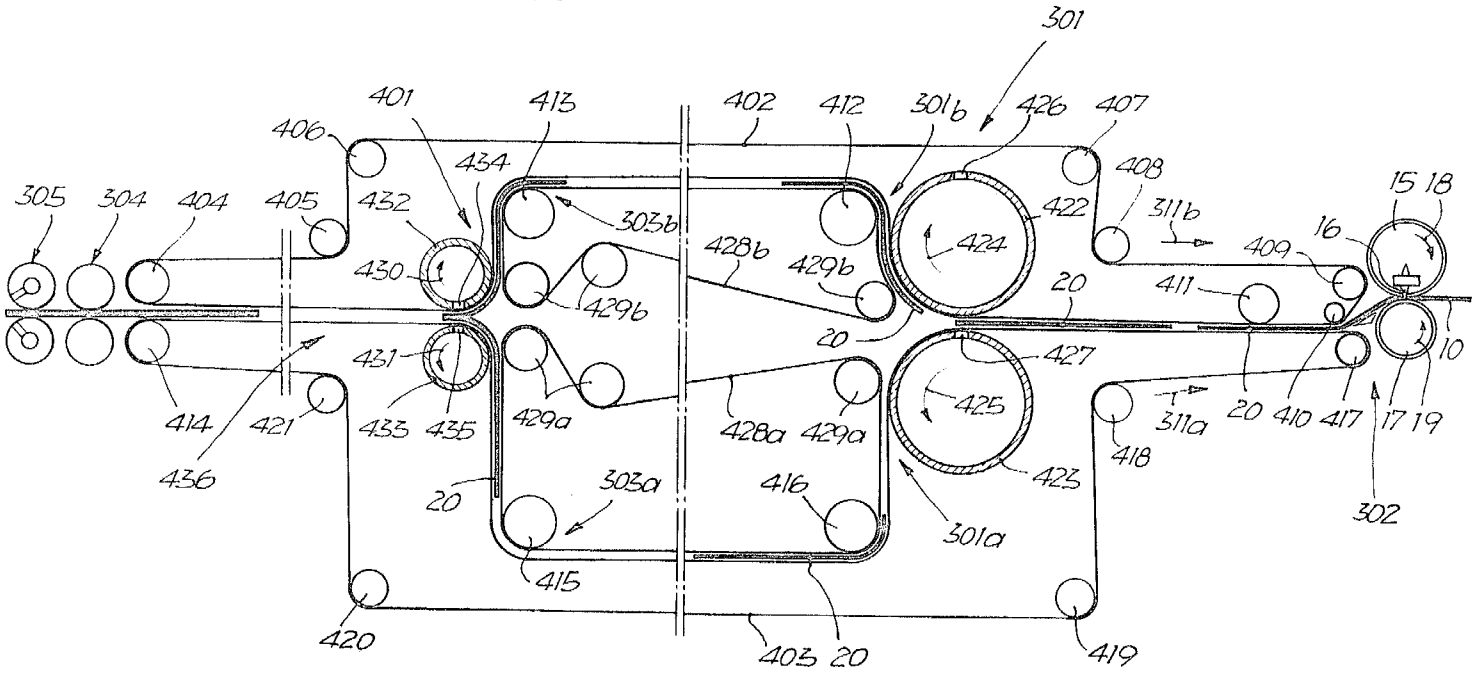
FIG. 6 is a view similar to FIG. 1, to show a second embodiment.

FIG. 6 illustrates a conveyor device for sheet-shaped workpieces, featuring a switch 301 which consists of a lower deflection device 301*a* and an upper deflection device 301*b*; the device receives, in rapid sequence, bags 20 of thermoplastic resin produced by a bag-welding machine, designated generally as 302, and shown merely diagrammatically in FIG. 6. By means of the two deflection devices 301*a* and 301*b*, these bags 20 are fed alternately via two additional conveyors 303*a* and 303*b* to a combination point 401 where every two bags are placed against each other in aligned position, as will be explained in further detail below. From the combining point 401 the pairs of bags are then fed, via a grooved disk system 304, known for this purpose and via a pair of brake shafts 305, also known per se, to a stacking place where the bags 20 are stacked to form flat piles.

The bag-welding machine 302 can be developed in any desired known manner. The embodiment of a conveyor for plastic bags which has been described here is, however, particularly suitable for welding machines which manufacture bags at a very high rate and which operate with a welding tool which rotates continuously but preferably with a non-uniform adjustable circumferential speed.

Such high capacity bag-welding machines are known, for instance, from German Pat. No. 1,479,807 and are described in pending German published application OS No. 2,810,204, OS No. 2,810,127 and OS No. 2,846,220. The conveyor described here can, however, be used also with smaller bag-manufacturing machines which operate with a welding strip which is movable up and down, with intermittently fed web of sheeting.

The welding machine 302 shown in FIG. 6 has a welding roller 15 which rotates continuously but nonuniformly, the same being fed a longitudinally slit tubular thermoplastic web of sheeting 10 by feed rollers (not shown) which form a conveyor slot. The welding roller 15 and an associated counter roller 17 define a welding slot. Roller 15 carries a welding tool 16 which produces a separation welding at the welding slot, upon rotation of the welding roller 15 in the direction of the arrow 18, while the counter roller 17 rotates in the opposite direction, as indicated by the arrow 19. As a result of the welding operation at 16–17, a bag 20 is thereby separated from the web of sheeting 10; at the same time, a side seam which trails in the direction of conveyance is formed on the bag 20, and a seam is formed at the front edge of the tubular sheet of webbing 10, thereby defining the leading side seam of the next bag.

Each of the two deflection devices 301*a* and 301*b* of the switch 301 has a plurality of endless conveyor belts 402 and 403 running alongside of each other in spaced parallel vertical planes, the conveyor surface of said belts being pervious to air. In the embodiment shown by way of example, the belts 402–403 are flat endless belts which are perforated by a plurality of holes. Each of the conveyor belts 402 and 403 is guided for movement in the direction of arrows 311*b* and 311*a* over rollers 404 to 413 and 414 to 421, respectively, some of these rollers being displaceable so as to serve as clamping and adjusting rollers, as will be discussed in further detail below. Furthermore, each of the conveyor belts 402 and 403 passes, in the region of the switch, around a separate corresponding deflection roller 422 and 423, respectively, wrapping around a part of the circumference thereof, as is shown in FIG. 6. The two deflection rollers 422 and 423 are so arranged opposite each other as to define a narrow region therebetween, for receipt of bags 20 discharged from the conveyor slot defined by and between the conveyor belts 402 and 403, the first conveyor; the narrow region between deflection rollers 422 and 423 establishes the deflection point of switch 301, for bags 20 delivered by belts 402 and 403. The rollers 409, 410, 411 and 417 which guide the conveyor belts 402 and 403 are so arranged relative to the delivery end of the bag-welding machine 302 that the conveyor slot forming the first conveyor extends from the deflection point of the switch up into the immediate vicinity of the welding machine, so that the bags 20 can be fed by the latter directly into the conveyor slot.

In the present illustrative embodiment, the deflection rollers 422 and 423 which, in operation, rotate in opposite directions, namely in the directions of rotation indicated by arrows 424 and 425, respectively, are of such size that their circumference is equal to twice the distance between the leading edges of successive adjacent bags 20 delivered to the switch. Each of the deflection rollers 422 and 423 furthermore has a row of suction openings 426 and 427 respectively extending along a generatrix of the deflection roller parallel to its axis, the insides of which openings are in communication with a source of vacuum, not shown in the drawing. The suction openings of the one deflection roller are at 180° phase-offset with respect to the suction openings of the other deflection roller so that, in combination with the above-indicated size of the circumference of the deflection roller, the result is obtained that the suction openings of each deflection roller are always synchronized for adjacency with the narrow region which forms the point of deflection of the switch towards the leading edge of each second bag 20. In the example shown in the drawing, the row of suction openings 427 of the lower deflection roller 423 is just at the deflection point. Due to the suction action of the suction openings 427, a suction stream is produced in the adjoining region of the air-pervious conveyor belt 403 which wraps around the deflection roller 423, which stream deflects the front edge of the bag 20 over this region downward upon the rotation of the deflection roller 423 in the direction indicated by the arrow 425, so that said bag 20 is fed for further transport to the second conveyor 303*a*, located at the bottom in the drawing. When the rear edge of this bag has passed the deflection point and the leading edge of the next following bag 20 enters the deflection point, the row of suction openings 426, due to the indicated circumferential size of the upper deflection roller 422, has reached the region of the deflection point so that, due to the suction acting through the air-pervious conveyor belt 402, this next-following bag 20 is now deflected upwards and fed for further transport to the second conveyor 303*b*, which is located on the top in the drawing.

Both of the air-pervious conveyor belts 402 and 403 cooperate in the region of the conveyor path which forms the second conveyor 303*a* and 303*b*, the cooperation being in each case with an associated auxiliary conveyor belt 428*a* and 428*b*, respectively; these belts are so guided over corresponding tensioning and guide rollers 429*a* and 429*b* that the auxiliary conveyor belts form, on the conveyor path extending from the switch 301 to the locale of combination 401, a conveyor slot with the adjoining conveyor surface of the associated air-pervious conveyor belt 403 or 402, respectively, the bags 20 being thereby transported to the point of combination 401. At the point of combination, two deflection rollers 432 and 433 are provided, rotating in opposite directions as indicated by arrows 430 and 431; each of these rollers 432–433 has a row of suction openings 434–435, respectively, so as to define (in combination with the corresponding air-pervious conveyor belts 402 and 403, respectively) separate switches which feed bags 20 from the second conveyors 303*a* and 303*b* to a common third conveyor 436. In the case of these switches, the size of the distance apart of the leading edges of the successive workpieces 20 is twice the circumference of the deflection rollers 432 and 433.

As already mentioned, the air-pervious conveyor belts 402 and 403 are so guided by the rollers 404, 405 and 414, 421, respectively, that they form the third conveyor 436, to transport pairs of bags (which have been placed against each other) past the point of combination 401, over the following pair of braking rollers, and up to a stacking device (not shown).

In order that the path lengths of the conveyor paths of the second conveyors 303*a* and 303*b* can be adapted in simple manner to each other so that the bags 20 fed are placed against each other in precisely aligned position at the place of combination 401, the rollers 415 and 416 are so developed that their position can be changed. For the equalizing of the tensile stress of the air-pervious conveyor belt 403 and the auxiliary conveyor belt 428*a* as is necessary due to the shifting of the position of these rollers, at least one of the tensioning and guide rollers 429*a* of the auxiliary conveyor belt and at least one of the rollers 417 to 421 of the air-pervious conveyor belt 403 (which rollers 417 to 421 are located outside the conveyor path) are yieldably mounted. Furthermore, at least one of the rollers conducting the upper air-pervious conveyor belt 402 is yieldably or displaceably mounted for equalization of tensile stress. For example, the rollers 401 and 410 can be developed as a displaceable unit, to enable adjustment of the inlet slot of the first conveyor path.

What is claimed is:

1. A conveyor device for conveying a continuous succession of sheetlike workpieces each having two sides and a leading edge, said device comprising first and second conveyor means for successively conveying said workpieces, each of said first and second conveyor means having an entrance and an exit and at least two engagement surfaces for engaging the respective sides of said workpieces, said second conveyor means comprising first and second conveyors for conveying workpieces along different paths from their respective entrances, switching means located at the exit of said first conveyor means and at the respective entrances of said second conveyor means for directing said workpieces supplied from the exit of said first conveyor means alternatively to the respective entrances of one and the other conveyor of said second conveyor means, said switching means comprising at least two deflection means, each having an endless circumferential surface and being movably mounted for moving said circumferential surface along an endless path, one of the two endless paths having at least a portion which leads from the exit of said first conveyor means to the entrance of one conveyor of said second conveyor means, the other of the two endless paths having at least a portion which leads from the exit of said first conveyor means to the entrance of the other conveyor of said second conveyor means, drive means for driving said deflection means so that the circumferential surface of one of said deflection means moves in a direction of rotation opposite to that of the circumferential surface of said other deflection means, at least a portion of each of said circumferential surfaces being permeable to air, means for producing a vacuum in said permeable portions, means for controlling the vacuum in said permeable portions so that a vacuum is produced in the permeable portion of one circumferential surface in alternation with the permeable portion of the other circumferential surface, said controlling means being operative to establish a vacuum condition at the permeable portion of one circumferential surface when contacting the leading edge of alternate workpieces supplied from said first conveyor means, and said controlling means being further operative to establish a vacuum condition at the permeable portion of the other circumferential surface when contacting the leading edge of remaining workpieces supplied from said first conveyor means, whereby leading edges of successive workpieces adhere in alternation to said permeable portions and are conveyed in alternation to the respective conveyor entrances of said second conveyor means.

2. A conveyor device according to claim 1, characterized by the fact that the rotational phases of said deflection bodies are so adapted to the conveyor phase of said first conveyor means that at least the leading-edge region of each successive workpiece contacts the circumferential surface of the applicable deflection means in the region of the air-permeable portion.

3. A conveyor device according to claim 2, characterized by the fact that an adjustable phase control is provided by means of which the revolving phase of each deflection means can be selectively adapted to the conveyor phase of said first conveyor means.

4. A conveyor device according to claim 2, characterized by the fact that each deflection means is developed as a cylindrical body having an interior cavity and supported for rotation about its axis, each deflection means having as its air-permeable region a borehole open at one end of the cylindrical body surface and open at its other end to said cavity.

5. A conveyor device according to claim 3, characterized by the fact that a differentially operative phasing mechanism is provided as said phase control.

6. A conveyor device according to claim 2, characterized by the fact that each deflection body is developed as a toothed belt which travels around at least two toothed-belt disks and which has at least one aperture at alternate-workpiece spacing, one of said toothed-belt disks being arranged at the outlet of said switching means, said toothed-belt disk having an interior vacuum cavity and at least one borehole which is connected with said cavity, the mouth of said borehole registering with the toothed-belt aperture in the course of movement of the toothed belt around the toothed-belt disk.

7. A conveyor device according to claim 6, characterized by the fact that the toothed-belt aperture is located in the bottom land between two teeth of the toothed belt, and that the mouth of the borehole is located in the top land of a tooth of the toothed belt disk.

8. A conveyor device according to claim 6, characterized by the fact that the number of teeth of the toothed belt is an integer multiple of the number of teeth of the toothed-belt disk at the outlet of said switching means.

9. A conveyor device according to claim 6, characterized by the fact that in the toothed-belt disk there are a plurality of spaced boreholes whose mouths form at least one array in the direction of travel of the toothed belt and that a corresponding number of apertures is provided in the toothed belt.

10. A conveyor device according to claim 2, characterized by the fact that each said deflection means comprises at least one endless conveyor belt having an air-pervious region over its entire length, which belt, at the deflection point of said switching means, wraps around a circumferential region of deflection roller which, in the cylindrical surface thereof cooperating with the air-pervious region of the conveyor belt, has at least one suction opening which can be connected with the vacuum-producing means, the size of the circumference of the deflection roller and the size of the spacing between the leading edges of two workpieces fed in succession to the switching means being in a ratio to each other such that one value is an integer multiple of the other.

11. A conveyor device according to claim 9, characterized by the fact that the array of borehole mouths extends over an arcuate section of the circumference of the toothed-disk which is at most as long as the length of the section of the circumference of the toothed-belt disk which is wrapped by the toothed belt.

12. A conveyor device according to claim 2, characterized by the fact that each said deflection means is one of at least two coaxial deflection body members which are parallel to each other and that coaxially between these deflection bodies there is arranged a deflection disk for a conveyor strand, preferably a round belt, of an additional conveyor.

13. A conveyor device according to claim 2, characterized by the fact that said first conveyor means is arranged downstream from a welding machine having a continuously rotating welding strip for the manufacture of bags of thermoplastic resin, and that the rate of revolution of said deflection means is synchronized with the rate of rotation of the welding strip.

14. A conveyor device according to claim 6, characterized by the fact that the courses of the two oppositely revolving toothed belts are located upstream of the outlet of said switching means as seen in the direction of conveyance and are arranged parallel to each other to define the conveyor slot of said first conveyor means.

15. A conveyor device according to claim 14, characterized by the fact that the axes of the toothed belt disks at the switching-means outlet are arranged in a plane which forms an angle of less than 90° with the plane of the conveyor slot.

16. A conveyor device according to claim 2, characterized by the fact that workpiece-braking devices are arranged at the downstream ends of the conveyors of said second conveyor means.

17. A conveyor device according to claim 16, characterized by the fact that stacking means for stacking the workpieces fed by the conveyors of said second conveyor means are arranged adjacent said workpiece-braking devices.

18. A conveyor device for conveying a continuous succession of sheetlike workpieces each having a leading edge, said device comprising first and second conveyor means for conveying said workpieces, said first conveyor means having an entrance and an exit, said second conveyor means comprising first and second conveyors for conveying workpieces along paths of different length from separate entrances to a common exit, switching means located at the exit of said first conveyor means and at the respective entrances of said second conveyor means for directing said workpieces supplied from the exit of said first conveyor means alternatively to the entrances of one and the other of said second conveyor means, said switching means comprising at least one deflection means which has an endless circumferential surface and is movably mounted for moving said circumferential surface along an endless path, said endless path having at least a portion which leads from the exit of said first conveyor means to the entrance of one conveyor of said second conveyor means, drive means for driving said deflection means so that said circumferential surface moves along said endless path, at least a portion of said circumferential surface being permeable to air, means for producing a vacuum in said permeable portion, means for controlling the vacuum in said permeable portion so that a vacuum is produced in said permeable portion when leading edges of selected workpieces adhere to said permeable portion of said circumferential surface and are conveyed to the entrance of said one of said second conveyor means, the different path lengths of said two second conveyors being so related to each other that two workpieces which were successively conveyed from the exit of said first conveyor means and alternatively switch-directed to the respective entrances of the conveyors of said second conveyor means are in overlapping relation at the common exit of said second conveyor means.

19. A conveyor device according to claim 18, characterized by the fact that said deflection means comprises at least one endless conveyor belt having an air-pervious region over its entire length, which belt, at the deflection point of said switching means, wraps around a circumferential region of a deflection roller which, in the cylindrical surface thereof cooperating with the air-pervious region of the conveyor belt, has at least one suction opening which can be connected with the vacuum-producing means, the size of the circumference of the deflection roller and the size of the spacing between the leading edges of two workpieces fed in succession to the switching means being in a ratio to each other such that one value is an integer multiple of the other.

20. A conveyor device according to claim 19, characterized by the fact that the air-pervious region of the conveyor belt is formed by perforation holes.

21. A conveyor device according to claim 19, characterized by the fact that the deflection roller has an axial length which corresponds at least to the width of the widest workpiece to be fed to the switching means, that a conveyor belt the width of which extends over the greater part of the axial length of the deflection roller, or a plurality of narrower conveyor belts traveling alongside of each other and which together cover the greater part of the axial length of the deflection roller, is or are provided and that as suction opening a single elongated opening extending along a generatrix of the deflection roller parallel to its axis or a plurality of separate openings arranged along said generatrix is or are provided.

22. A conveyor device according to claim 19, further including a welding machine positioned to discharge successively welded workpieces to said first conveyor means, the conveyor belt which serves as a part of the deflection means being also used to form a conveyor surface of said first conveyor means, for feeding workpieces from the welding machine to said switching means.

23. A conveyor device according to claim 22, characterized by the fact that the conveyor belt which serves as part of the deflection means is also used to form a conveyor surface of one conveyor of said second conveyor means.

24. The conveyor device of claim 18, further comprising braking means for braking workpieces supplied from said common exit, and stacking means located behind said braking means for stacking braked workpieces.

25. A conveyor device according to claim 23, wherein said switching means comprises at least two deflection bodies forming a pair whose circumferential surfaces are adapted to be driven in opposite directions and form a conveyor slot into which said first conveyor means discharges, the two deflection bodies deflecting the workpieces entering into the conveyor slot as desired, preferably alternately, into one of the two conveyors of said second conveyor means.

26. A conveyor device according to claim 25, characterized by the fact that the air-pervious conveyor belt which forms the second deflection body is also used for the formation of a second conveyor surface of said one conveyor of said second conveyor means, thereby cooperating with the conveyor surface of the first air-pervious conveyor belt to form a conveyor slot via which workpieces can be fed from the welding machine to said switching means.

27. A conveyor device according to claim 26, characterized by the fact that the second air-pervious conveyor belt is also used to form a conveyor surface of the second conveyor of said second conveyor means.

28. A conveyor device according to claim 27, characterized by at least one auxiliary conveyor belt which, together with the associated air-pervious conveyor belt of the corresponding conveyor of said second conveyor means, forms a conveyor slot via which workpieces can be fed from said to the place of combination switching means to said common exit.

* * * * *